US008556447B2

(12) United States Patent
Griggs

(10) Patent No.: US 8,556,447 B2
(45) Date of Patent: Oct. 15, 2013

(54) MOUNTABLE AND REMOVABLE PERSONAL MIRROR

(76) Inventor: Andre J. Griggs, Detroit, MI (US)

( * ) Notice: Subject to any disclaimer, the term of this patent is extended or adjusted under 35 U.S.C. 154(b) by 36 days.

(21) Appl. No.: 13/373,964

(22) Filed: Dec. 7, 2011

(65) Prior Publication Data

US 2013/0148336 A1 Jun. 13, 2013

(51) Int. Cl.
*F21V 33/00* (2006.01)
*G02B 7/182* (2006.01)

(52) U.S. Cl.
USPC ..... 362/142; 362/144; 359/850; 359/854

(58) Field of Classification Search
USPC ..... 362/135, 142, 144; 359/850, 854, 862, 359/863, 872
See application file for complete search history.

(56) References Cited

U.S. PATENT DOCUMENTS

| | | | | |
|---|---|---|---|---|
| 2,668,477 | A * | 2/1954 | Shaikun | 359/854 |
| 4,848,542 | A | 7/1989 | Burnette et al. | |
| 4,950,065 | A | 8/1990 | Wyman | |
| 5,093,748 | A | 3/1992 | Higdon | |
| 5,237,459 | A * | 8/1993 | Strauss | 359/863 |
| 6,840,639 | B2 | 1/2005 | Zadro | |
| 6,854,852 | B1 | 2/2005 | Zadro | |
| 7,150,538 | B2 | 12/2006 | Vander Horst | |
| 7,562,980 | B2 | 7/2009 | Rymniak | |
| 7,903,350 | B2 | 3/2011 | Eccher et al. | |
| 7,942,536 | B1 | 5/2011 | Johnson | |

* cited by examiner

*Primary Examiner* — David V Bruce
(74) *Attorney, Agent, or Firm* — Thomas Heed

(57) ABSTRACT

A mountable, adjustable, and removable personal mirror system, which allows the user to obtain close-in or far-away panoramic views. The user can adjust the position (how close together), the angle, and the orientation (e.g., side-to-side or top-and-bottom) of the mirrors. By so adjusting the mirrors, the user will see a much wider variety of visual information than with currently existing personal mirrors.

8 Claims, 4 Drawing Sheets

MOUNTABLE AND REMOVABLE PERSONAL MIRROR

FIELD OF INVENTION

This invention relates to the fields of mirrors, specifically, panoramic mirrors for personal uses, such as grooming, dressing, and applying cosmetics.

BACKGROUND OF INVENTION

Mirrors are used for a variety of personal uses including, but not limited to, grooming, dressing, applying cosmetics, and cutting hair. A single flat mirror is often problematic, because it does not provide the user with a comprehensive image. In other words, a single, flat mirror provides a two-dimensional representation of a three-dimensional reality.

Often times, this two-dimensional representation is not enough. For example, when cutting or styling hair, views from multiple angles are often desired. Additionally, when applying cosmetics, a two-dimensional image is of limited effectiveness in assessing the consistency and effect of the make-up. Even when dressing, a two-dimensional representation fails to properly convey how clothing looks on the user. A person is often left with no idea how the side or back of an outfit looks, in reality.

The two-dimensional image often needs magnification, also. When shaving, grooming, or applying cosmetics, many users need a magnified image in order to get a proper view.

The lighting available, when viewing a two-dimensional image with a traditional flat mirror, can also be problematic. As one moves closer to an image, more light is often needed. As one moves back, less light is needed (more of the ambient light is available to the mirror).

Part of the issue is the nature of optics. To obtain a panoramic view of a near object, one needs closely placed angle mirrors. In order to obtain a panoramic view of a farther away object, one needs mirrors, placed at an angle, relatively further apart. The ambient light creates a second issue. For close-up viewing, additional light is needed. For a far away, perspective view, a lighted mirror actually obscures the image. Magnification creates a third issue. For close-up viewing, a magnifying mirror is often useful. For further way viewing, magnification just creates a distorted, fun-house mirror, image.

Many attempts have been made to address the two-dimensional view problem. The market is rife with hand-held mirrors, small cosmetic mirrors, larger cosmetic cases which have two or three mirrors, and the like. Although there have been many attempts made to address this problem, commercially, none of them have succeeded in meeting the market need, as evidenced by the lack of any predominant commercial application. In other words, no single device or mirror has market dominating sales. Additionally, a quick survey of any home usually yields a number of mirrors intended to address the problem, from hand-held mirrors to magnifying mirror cases, most of which are used only for a limited period of time, until the user becomes disenchanted with the solution.

The prior art also contains significant attempts to address these problems.

U.S. Pat. No. 7,942,536, by named inventor Johnson ("Johnson 536"), is entitled, "Panoramic cosmetic mirror providing multiple perspectives." Johnson 536 teaches a self-contained device offering a five mirrors to give the user a panoramic view. The central mirror is surrounded by four side mirrors. The central mirror is flat. The four side mirrors are beveled, so that each mirror reflects the other four mirrors.

U.S. Pat. No. 7,903,350, by named inventors Eccher, et. al., ("Eccher 350"), is entitled, "Magnifier detachably affixed to cosmetic container." Eccher 350 teaches a small magnifying mirror that can be affixed to cosmetic containers through a grip-type device.

U.S. Pat. No. 7,562,980, by named inventors Szpur, et. al., ("Szpur 980"), is entitled, "Make-up kit." Szpur 980 teaches an eye make-up aid, for people who need corrective lenses, which is housed in a traditional compact cosmetic case. The kit comes with a suction cup so that it can be mounted to a wall-mounted mirror, such as one would find in a bathroom. The Make-up kit does not interact, optically, with the mirror to which it is mounted. It has corrective lenses built-in, so that a person who needs to wear glasses or contacts can apply eye make-up without their glasses or contacts.

U.S. Pat. No. 5,093,748, by named inventor Higdon ("Higdon 748"), is entitled, "Portable rotating bathroom mirror." Higdon 748 teaches a portable mirror with suction cups, which can be mounted in the shower. The invention has fog-proof glass, and suction cups which are designed to support the device when mounted to shower tile.

U.S. Pat. No. 4,950,065, by named inventor Wyman ("Wyman 065"), is entitled, "Shower mirror." Wyman 065, also, teaches a shower-mountable mirror, which uses one or more suction cups.

U.S. Pat. No. 4,848,542, by named inventors Burnette, et. al., ("Burnette 542"), is entitled, "Package for retaining and mounting a mirror." Burnette 542 teaches a frame and bracket assembly, which can contain a mirror, which can be removably affixed to a flat surface through the use of suction cups.

U.S. Pat. No. 7,150,538, by named inventor Vander Horst ("Vander Horst 538"), is entitled, "Detachable extension mirror." Vander Horst 538 teaches an extension mirror, which is mountable to an automotive rear-view mirror. The mirror pivots, allowing the user to aim it. The extension mirror does not interact, optically, with the rear view mirror.

U.S. Pat. No. 6,840,639, by named inventor Zadro ("Zadro 639"), is entitled, "Dual magnification table top/wall mount mirror system." Zadro 639 teaches a dual magnification mirror, which is mountable with suction cups. The dual magnification mirrors do not interact, optically, with any other mirror.

U.S. Pat. No. 6,854,852, by named inventor Zadro ("Zadro 852"), is entitled, "Dual magnification reversible spot mirror releasably attachable to flat surfaces." Zadro 852 teaches a variation of the suction-cup mounting system. The dual magnification mirrors do not interact, optically, with any other mirror.

None of the prior art references address the core problem with the art: people need a panoramic view which is adjustable for size of image, angle of image, and amount of additional light provided.

SUMMARY OF THE INVENTION

The present invention is pair of mountable and removable mirrors, which come with their own adjustable light source. Each mirror has a pair of suction cups that allows the mirror to be attached to another, fixed mirror, such as a bathroom mirror, a full-length dressing mirror, or a dressing-table mirror. The suction cups are connected to the frame with an adjustable pivot. The adjustable pivot has sufficient retention force that the mirror will remain in position one it is adjusted. Notwithstanding the positional stability, the pivots are easily, manually, adjustable by the user. The mirror can have more than one set of suction cups. For example, the mirror might have a pair of suction cups on both the long- and short-sides of a rectangular mirror.

The mirrors come in a frame that is made out of plastic. The frame holds the mirrors, light source, and suction cups. The frame which has the suction cups on the left-hand side of the frame when the non-magnifying mirror is aimed at the user is denoted as the Right-Hand Frame. The frame which has the suction cups on the right-hand side of the frame when the non-magnifying mirror is aimed at the user is denoted as the Left-Hand Frame. This is because, when configured for creating a panoramic view in conjunction with a fixed mirror, the Right-Hand Frame will be on the right of the user and the Left-Hand Frame will be on the left of the user.

Optically, there are several potential embodiments for the mirror arrangement in the frame. Each frame can contain a single mirror with no magnification. Each frame can contain a mirror with no magnification on one side, and a magnifying mirror on the other side. Each frame can contain a single mirror with no magnification on one side, and an arrangement of magnifying mirrors on the other side.

Each mirror frame can contain an adjustable light source. The light source is designed to provide better lighting for close-up work such as shaving, or applying cosmetics. The light source can be battery operated, or plug-in. The light source can use LEDs, incandescent light bulbs, compact fluorescent light bulbs, halogen light bulbs, or any other type of compact lighting system, which may be appropriate.

By properly selecting mounting positions for the Right-Handed Frame and the Left-Handed Frame, and by properly adjusting the angles between the Right-Handed Frame, the Left-Handed Frame, and the fixed mirror on which they are mounted, the user is able to get an infinite variety of panoramic views. The easy ability to adjust view angles and viewing distance will allow the user to see the desired view in the mirrors. By adjusting the light source, the user will be able to see fine detail, up close, or large details, far away.

BRIEF DESCRIPTION OF THE DRAWINGS

There are five relevant drawings.

DETAILED DESCRIPTION OF THE PREFERRED EMBODIMENTS

The following description represents the inventor's current preferred embodiment. The description is not meant to limit the invention, but rather to illustrate its general principles of operation and construction. Examples are illustrated with the accompanying drawings.

Figure 1:
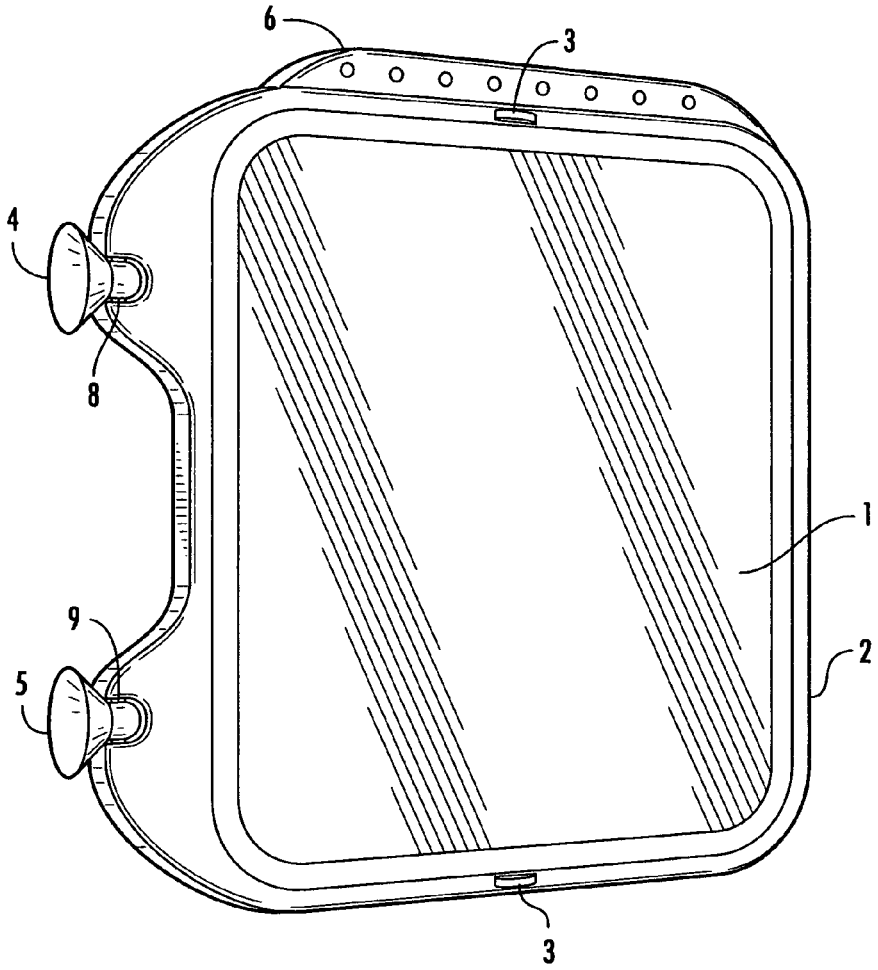
FIG. 1 is a front perspective view of the Right Hand Frame of the present invention.
Figure 2:
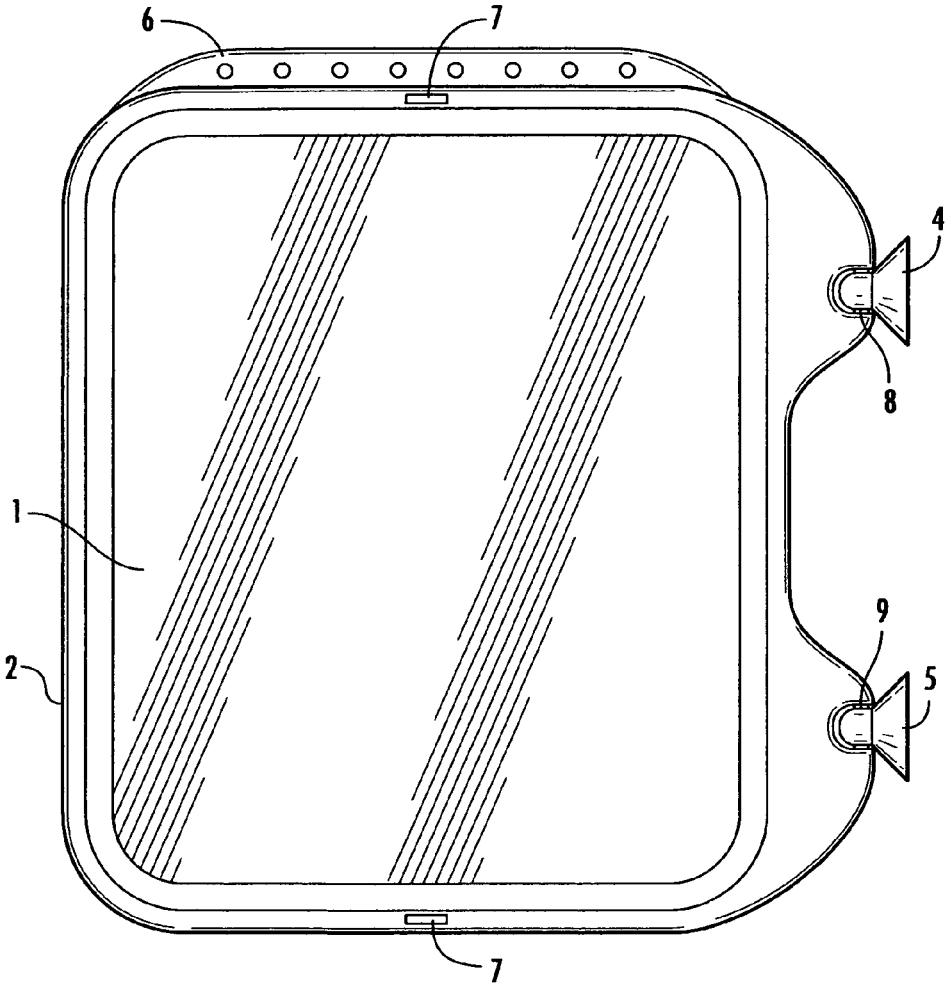
FIG. 2 is a front view of the Left Hand Frame of the present invention.

FIG. 1 shows the front view of the preferred embodiment, for a Right Handed Frame. The invention is comprised of a mirror 1, a frame 2, a male connector 3 to fasten the Right-Handed Frame to the Left-Handed Frame for storage, suction cups 4, 5, a light source 6, and pivotable suction cup mounts 8, 9. FIG. 2 shows the front view of the preferred embodiment, for a Left-Handed Frame. The invention is comprised of a mirror 1, a frame 2, a female connector 7 to connect the Left-Handed Frame (FIG. 2) to the Right-Handed Frame (FIG. 1) for storage, suction cups 4, 5, a light source 6, and pivotable suction cup mounts 8, 9. The male connector 3 fits into the female connector 7, joining the Left-Handed Frame and the Right-Handed Frame for storage.

Figure 3:
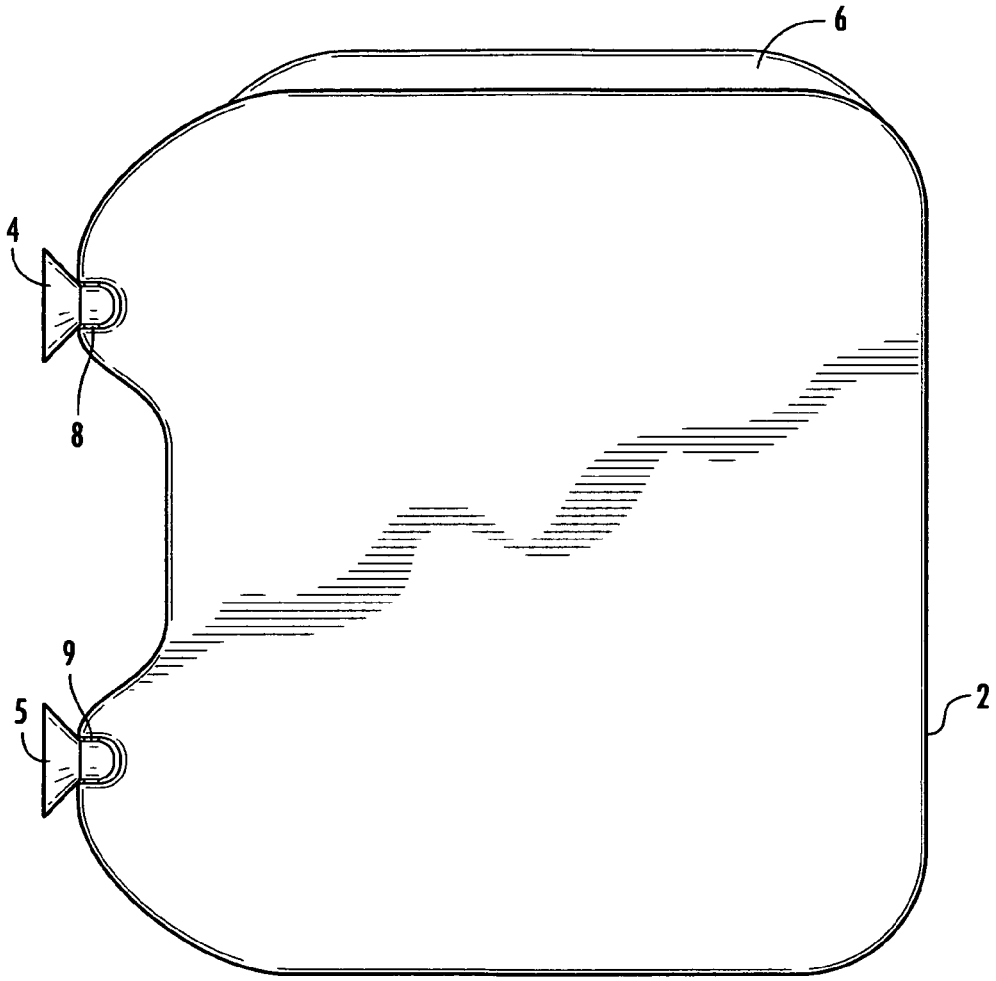
FIG. 3 is a rear view of the Left Hand Frame of the present invention.
Figure 4:
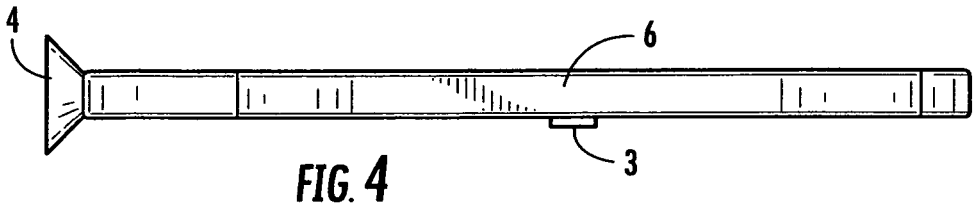
FIG. 4 is a top view.
Figure 5:
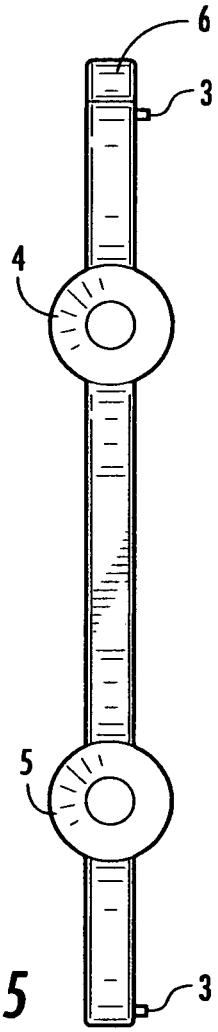
FIG. 5 is a side view.

Each frame contains only a single, non-magnifying mirror 1. FIG. 3 shows the back of the frame 1. By using only one mirror 2 in each frame 1, the preferred embodiment allows for easy storage of the invention. If a mirror were to be used on the back of the frame 1, the invention would need a storage case or container to protect the exposed mirrors.

The light source 6 is a battery-powered row or array of LEDs. The batteries can be rechargeable or disposable. The lights 6, so configured, will only use a small amount of power, making the batter power ample.

One set of suction cups 4, 5 are mounted to each frame 1. The suction cups 4, 5 are on pivots 8, 9 which allow the user to adjust the relative position of the frame 1. The pivots 8, 9 have a retention force that allows for adjustment, but firmly hold the frame in place, once adjusted. By pivoting the frame 1 using the pivots 8, 9, the user can create the proper angles between the fixed mirror, Right-Handed Frame, and Left-Handed Frame in order to get the desired view.

I claim:

1. A mountable and removable mirror system, comprising at least one plastic frame, at least one mirror per frame, at least two suction cups arranged at least two suction cups per frame side, and a plurality of pivotable plastic arms, with their rotational axis integral to the plastic frame in order to keep the plastic arms from being damaged during use, connecting each suction cup to each said frame side.

2. A mountable and removable mirror system, comprising at least two frames, one with a male connector and one with a female connector, allowing for the frames to be connected in a storage configuration which protects said mirrors; at least one mirror per frame; at least two suction cups, per frame, arranged at least two suction cups per frame side; and a plurality of pivotable arms, connecting each suction cup to each said frame side.

3. The invention in 2, wherein there are two mirrors in each frame, with their reflective surfaces oriented 180° apart.

4. The invention in 3, wherein one of the mirrors in each frame is non-magnified and the other mirror is magnified.

5. The invention in 2, wherein one mirror in each frame is non-magnified, and on the face opposite the mirror face, there is a plurality of smaller, magnified mirrors, joined in a mechanism that allows the user to rotate the magnified mirrors in order to select the right magnification factor for each frame.

6. The invention in 2, wherein the system contains a light source in each frame.

7. The invention in 6, wherein the light source is adjustable.

8. The invention in 6, wherein the light source is battery powered, light emitting diodes.

* * * * *